US005428925A

United States Patent [19]

Snyder

[11] Patent Number: 5,428,925

[45] Date of Patent: Jul. 4, 1995

[54] FIBERGLASS BULKHEAD DOOR ASSEMBLY

[76] Inventor: Kendrick M. Snyder, 663 River Rd., Westport, Mass. 02790

[21] Appl. No.: 303,425

[22] Filed: Sep. 9, 1994

[51] Int. Cl.[6] ..... E06B 3/32

[52] U.S. Cl. ..... 49/367; 49/381; 49/397

[58] Field of Search ..... 49/366, 367, 368, 369, 49/381, 397, 401, 402, 386

[56] References Cited

U.S. PATENT DOCUMENTS

| | | | |
|---|---|---|---|
| 1,837,916 | 12/1931 | Michelman | 49/367 |
| 2,582,540 | 1/1952 | Gruse | 49/367 |
| 3,103,996 | 9/1963 | Wyatt, Jr. | 49/367 |
| 3,337,991 | 8/1967 | Adams | 49/366 X |
| 3,340,649 | 9/1967 | Erlandsen | 49/367 |
| 4,873,791 | 10/1989 | Lyons, Sr. | 49/386 |
| 5,067,277 | 11/1991 | Magalotti | 49/386 |

*Primary Examiner*—Philip C. Kannan
*Attorney, Agent, or Firm*—Wolf, Greenfield & Sacks

[57] ABSTRACT

A fiberglass bulkhead door assembly includes a bulkhead enclosure for mounting on a bulkhead, at least one door and top and bottom hinges for mounting the door to the bulkhead enclosure. The bulkhead enclosure includes fiberglass side walls, a sloping fiberglass top wall and a tie bar connected between the side walls. The top wall has a door opening. The door is movable between a closed position covering the door opening and a open position providing access to the bulkhead. Each of the hinges includes a fixed member attached to the bulkhead enclosure and a movable member attached to the door. The fixed member of the bottom hinge is rigidly affixed to the tie bar so as to transfer stress to the tie bar during opening and closing of the door.

15 Claims, 2 Drawing Sheets

FIBERGLASS BULKHEAD DOOR ASSEMBLY

FIELD OF THE INVENTION

This invention relates to a door assembly for enclosing and providing access to a bulkhead in a home or other building.

BACKGROUND OF THE INVENTION

Homes and other buildings frequently have a bulkhead for providing access to the cellar, or basement, of the building from its exterior. The bulkhead is usually in the form of a concrete stairway which leads to an opening in the building foundation. A bulkhead door assembly is mounted to the top of the bulkhead. The door assembly typically has the form of a sloping enclosure and one or two doors for providing access to the bulkhead.

The bulkhead door assembly performs several functions. It encloses the bulkhead entrance and provides protection against inclement weather. The doors can usually be locked in their closed positions to prevent unauthorized entry. The bulkhead door assembly should provide relatively unhindered access to the stairway when the doors are in their open positions. Finally, the bulkhead door assembly should be reasonably attractive.

Prior art bulkhead door assemblies have been fabricated of wood or steel. The wood door assemblies rot, and the steel door assemblies rust. The rotting or rusting is accelerated when the door assembly is in a shaded or damp location. The deterioration of the door assembly causes several problems. The door assemblies become unsightly and may leak, thus permitting water to enter the basement during rainstorms and other inclement weather. Eventually, the building owner is subjected to the inconvenience and expense of replacing the bulkhead door assembly.

It is desirable to provide a bulkhead door assembly which overcomes the above problems and disadvantages. The bulkhead door assembly should withstand severe weather conditions over prolonged periods without deterioration, should have an attractive appearance, and should be relatively light in weight and low in cost.

SUMMARY OF THE INVENTION

According to the present invention, a fiberglass bulkhead door assembly comprises a bulkhead enclosure for mounting on a bulkhead, at least one door and top and bottom hinges for mounting the door to the bulkhead enclosure. The bulkhead enclosure includes fiberglass side walls, a sloping fiberglass top wall and a tie bar connected between the side walls. The top wall has a door opening. The door is movable between a closed position covering the door opening and an open position providing access to the bulkhead. Each of the hinges includes a fixed member attached to the bulkhead enclosure and a movable member attached to the door. The fixed member of the bottom hinge is rigidly affixed to the tie bar so as to transfer stress to the tie bar during opening and closing of the door. The bulkhead door assembly typically includes a pair of doors.

The tie bar preferably comprises a metal strip positioned at the bottom of the door opening for attachment to the bulkhead. By securing the fixed member of the bottom hinge to the tie bar, stress to the fiberglass top wall is minimized during opening and closing of the door.

The top wall is preferably provided with an upwardly extending flange around the top and sides of the door opening. The doors are preferably provided with peripheral flanges that surround the upwardly extending flange when the doors are in their closed positions. The door assembly may include a U-shaped channel attached to one of the doors and positioned below the gap between the doors so that rainwater is directed downwardly and is prevented from entering the bulkhead. The fixed member of the bottom hinge preferably has a right angle configuration including a first portion affixed to the tie bar and a second portion extending upwardly through the top wall for pivotal attachment to the movable member of the bottom hinge.

The bulkhead door assembly may include an air cylinder connected between each of the doors and the bulkhead enclosure.

BRIEF DESCRIPTION OF THE DRAWINGS

For a better understanding of the present invention, reference is made to the accompanying drawings which are incorporated herein by reference and in which.

DETAILED DESCRIPTION

Figure 1:
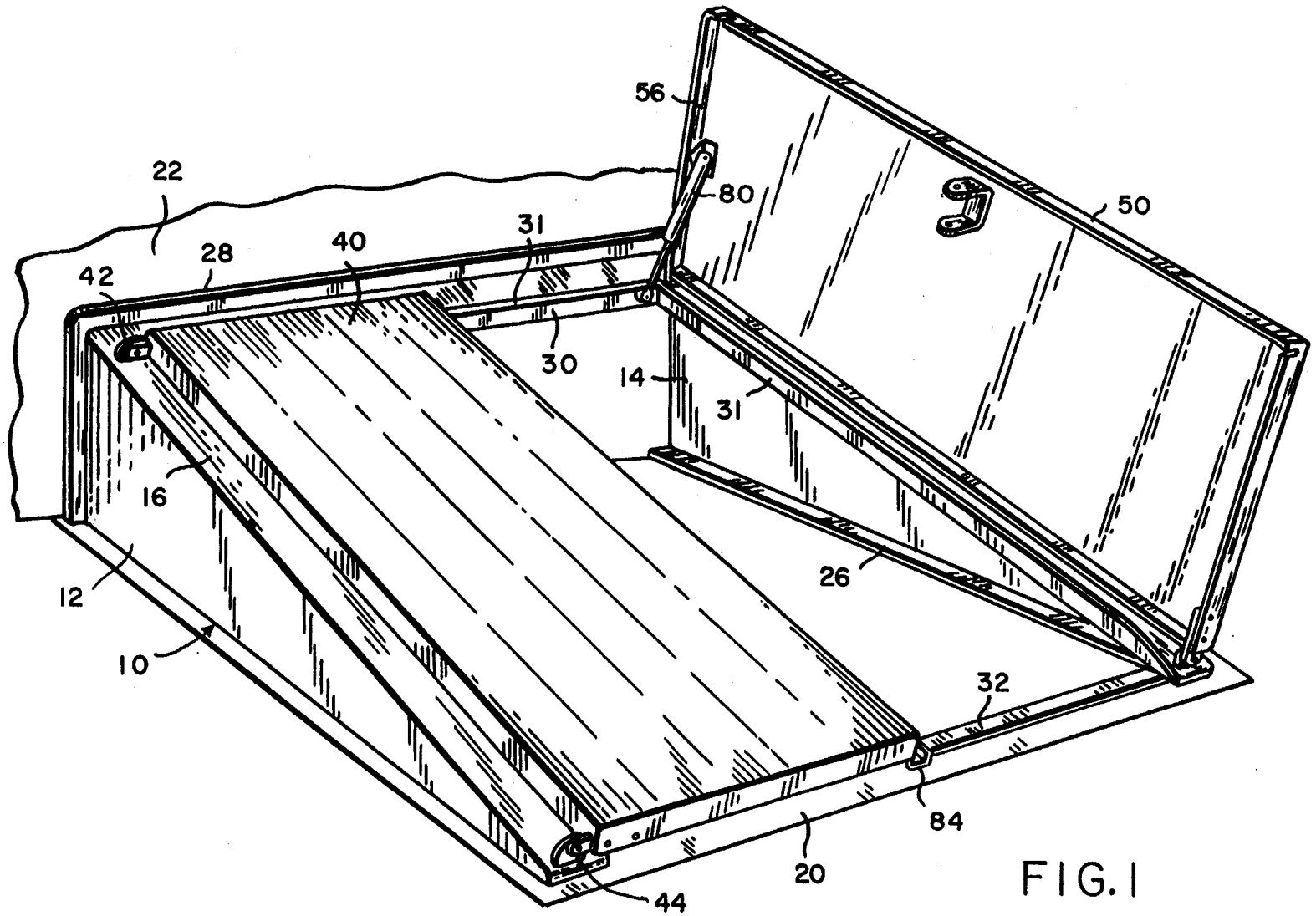
FIG. 1 is a perspective view of the bulkhead door assembly of the present invention, with one door in the open position.
Figure 2:
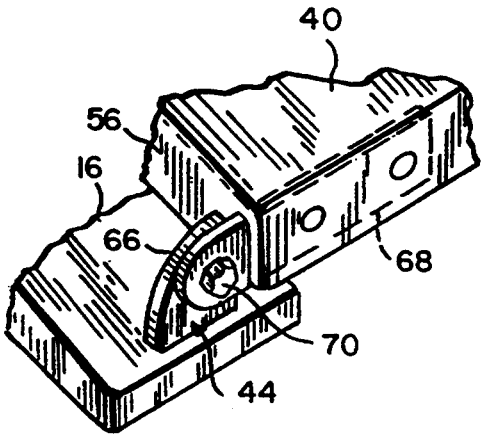
FIG. 2 is an enlarged, partial view of the bulkhead door assembly, showing the bottom left hinge.

A bulkhead door assembly in accordance with a preferred embodiment of the present invention is shown in FIG. 1. The primary components of the door assembly are a bulkhead enclosure 10 and left and right doors 40 and 50. The bulkhead enclosure 10 includes fiberglass side walls 12 and 14, and a sloping fiberglass top wall 16. The bulkhead enclosure 10 is mounted on a bulkhead 20, which typically is fabricated of concrete and includes a stairway leading to the basement of a building 22. Each of the side walls 12 and 14 includes an inwardly extending mounting flange 26 along its lower edge for attachment of the bulkhead enclosure 10 to the bulkhead 20, typically by masonry screws. The bulkhead enclosure 10 abuts against building 22 and includes a weather flange 28 to permit a weathertight seal between bulkhead enclosure 10 and building 22. The top wall 16 of the bulkhead enclosure 10 is provided with a door opening 30 and an upwardly extending flange 31 along the top and sides of door opening 30.

A tie bar 32 is connected between the side walls 12 and 14 at or near their bottom ends. The tie bar 32 is preferably an aluminum strip having mounting holes 34 for securely attaching tie bar 32 to bulkhead 20, such as by stainless steel screws.

The left door 40 is mounted to bulkhead enclosure 10 by a top hinge 42 and a bottom hinge 44. The right door 50 is mounted to bulkhead enclosure 10 by a top hinge 52 and a bottom hinge 54. Each door 40, 50 is movable between a closed position (door 40 is shown in the closed position in FIG. 1) and an open position (door 50 is shown in the open position in FIG. 1). Each of the doors 40 and 50 is fabricated of fiberglass and includes a peripheral flange 56. The flanges 56 extend perpendicular to the plane of the doors 40, 50 and strengthen the doors. In addition, the peripheral flanges 56 surround the upwardly extending flange 31 on top wall 16 when the doors are in the closed position, thereby preventing entry of rainwater into the bulkhead around the edges of doors 40 and 50. The upwardly extending flange 31 channels rainwater away from door opening 30.

The side walls 12 and 14, the top wall 16 and the doors 40 and 50 can, for example, be fabricated of a standard fiberglass material having a thickness of 0.25 to 0.50 inch. The fiberglass construction is attractive and is durable under a variety of weather conditions.

Figure 3:
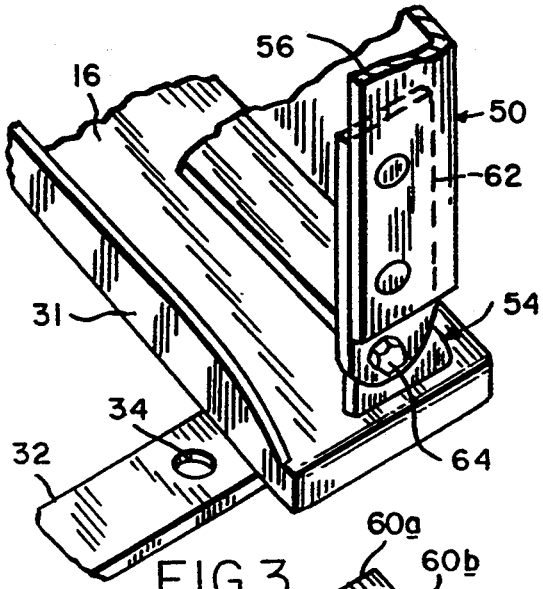
FIG. 3 is an enlarged, partial view of the bulkhead door assembly, showing the bottom right hinge.
Figure 3A:
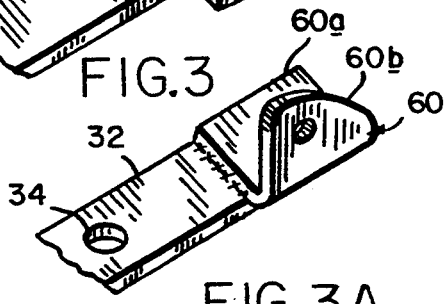
FIG. 3A is a partial view of the tie bar and the fixed member of the bottom hinge.

As shown in FIGS. 3 and 3A, the right bottom hinge 54 includes a fixed member 60 and a movable member 62 connected by a pivot pin 64. The fixed member 60 has a right angle configuration with a first portion 60*a* rigidly attached to the right end of tie bar 32, such as by welding, and a second portion 60*b* that extends upwardly through top wall 16 for pivotal connection to movable member 62. The first portion 60*a* of fixed member 60 is also attached to the inside surface of top wall 16. The movable member 62 can comprise a metal strip attached to an inside surface of peripheral flange 56 of door 50. The bottom left hinge 44 has a similar construction, including a fixed member 66 and a movable member 68 connected by a pivot pin 70. The fixed member 66 is rigidly attached to the left end of tie bar 32.

In the disclosed structure, the movable member 60 of each bottom hinge 44, 54 is rigidly attached to tie bar 32, which in turn is secured to bulkhead 20. Thus, stresses transmitted through the bottom hinges 44 and 54 during opening and closing of the doors 40 and 50 are applied to the rigidly mounted tie bar 32 rather than to the top wall 16 of the bulkhead enclosure 10. Thus, the top wall 16 can be fabricated of a relatively lightweight fiberglass. In the absence of this structure it, would be necessary to fabricate top wall 16 of much heavier fiberglass to provide adequate structural support for the bottom hinges.

The top hinge 52 includes a fixed member 72 and a movable member 74 connected by a pivot pin 76. The fixed member 72 has a right angle configuration with a first portion 72*a* attached to an inside surface of top wall 16 and a second portion 72*b* extending upwardly through top wall 16 for pivotal connection to movable member 74. The movable member 74 is preferably a metal strip attached to an inside surface of peripheral flange 56 on door 50. The top hinge 42 for door 40 has a similar structure. Although the top hinges 42 and 52 are attached directly to top wall 16 without additional support, the top hinges are typically subjected to less stress than the bottom hinges during opening and closing of the doors.

Figure 4:
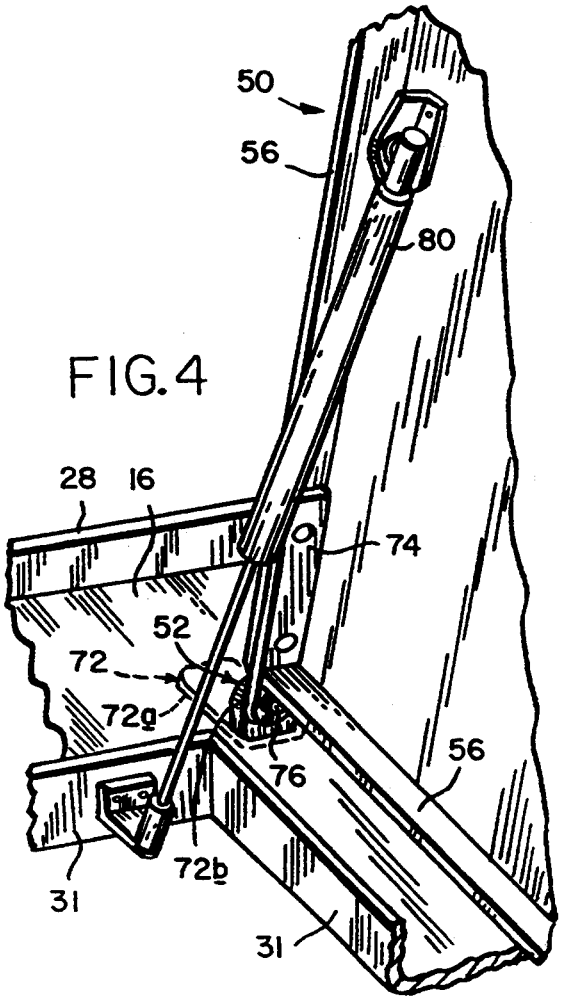
FIG. 4 is an enlarged partial view of the bulkhead door assembly, showing the top right hinge and the air cylinder.

The bulkhead door assembly preferably further includes an air cylinder 80 connected between each of the doors 40 and 50 and the bulkhead enclosure 10. As shown in FIGS. 1 and 4, the air cylinder 80 can be connected to the upwardly extending flange 31 around door opening 30. The air cylinder holds each door in an open position and prevents slamming of the doors when they are closed. In a preferred embodiment, air cylinder 80 is a Springlift type SL-3380.

Figure 5:
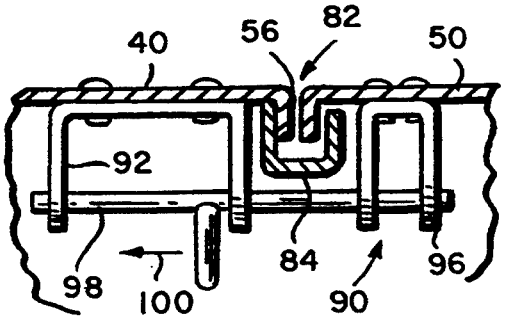
FIG. 5 is a partial cross-sectional view of the bulkhead door assembly with both doors closed, showing the locking bolt and U-shaped channel.

As shown in FIG. 5, a gap 82 typically exists between the doors 40 and 50 when they are in their closed positions. To prevent entry of rainwater and other foreign material into the bulkhead, a U-shaped channel 84 is attached to one of the doors 40, 50, preferably by attachment of one side of channel 84 to peripheral flange 56. The U-shaped channel 84 is mounted below and in alignment with gap 82 and has its open side facing upwardly toward gap 82. The U-shaped channel 84 directs rainwater downwardly away from the bulkhead door assembly and prevents its entry into the bulkhead.

The bulkhead door assembly is further provided with a latch mechanism 90 as shown in FIG. 5 to prevent unauthorized entry into the building through the bulkhead. The latch mechanism 90 includes a U-shaped member 92 attached to the inside surface of door 40 and a U-shaped member 96 attached to the inside surface of door 50. The members 92 and 96 have aligned holes for receiving a bolt 98. When the bolt 98 is in a locked position, as shown in FIG. 5, it passes through both members 92 and 96 and prevents opening of doors 40 and 50. When the bolt 98 is moved to the left, as indicated by arrow 100, it is retracted from member 96 and permits the doors 40 and 50 to be opened. It will be understood that a variety of different latch mechanisms can be utilized for locking the doors 40 and 50 in their closed positions.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A fiberglass bulkhead door assembly comprising:

a bulkhead enclosure for mounting on a bulkhead, said bulkhead enclosure including fiberglass side walls, a sloping fiberglass top wall between said side walls and a tie bar connected between said side walls, said top wall having a door opening;

a pair of fiberglass doors movable between closed positions covering said door opening and open positions providing access to said bulkhead; and a top hinge and a bottom hinge for mounting each of said doors to said bulkhead enclosure, each of said hinges including a fixed member attached to said bulkhead enclosure and a movable member attached to one of said doors, the fixed member of each bottom hinge being rigidly affixed to said tie bar so as to transfer stress to said tie bar during opening and closing of said doors.

2. A fiberglass bulkhead door assembly as defined in claim 1 wherein said tie bar comprises a metal strip positioned at the bottom of said door opening for attachment to said bulkhead.

3. A fiberglass bulkhead door assembly as defined in claim 2 wherein the fixed member of each bottom hinge has a right angle configuration including a first portion affixed to said tie bar and a second portion extending upwardly through said top wall for pivotal attachment to the movable member of said bottom hinge.

4. A fiberglass bulkhead door assembly as defined in claim 3 wherein said top wall is provided with an upwardly extending flange around the top and sides of said door opening and wherein said doors are provided with peripheral flanges that surround said upwardly extending flange when said doors are in their closed positions.

5. A fiberglass bulkhead door assembly as defined in claim 4 wherein said doors define a gap between them in their closed positions and wherein said door assembly further includes a U-shaped channel attached to one of said doors and positioned below said gap so that rainwater is directed downwardly and is prevented from entering the bulkhead.

6. A fiberglass bulkhead door assembly as defined in claim 4 wherein said movable members of said hinges are attached to the peripheral flanges on said doors.

7. A fiberglass bulkhead door assembly as defined in claim 1 wherein the fixed member of each top hinge has a right angle configuration including a first portion attached to an inside surface of said top wall and a second portion extending through said top wall for pivotal attachment to the movable member of said top hinge.

8. A fiberglass bulkhead door assembly as defined in claim 1 further including an air cylinder connected between each of said doors and said bulkhead enclosure.

9. A fiberglass bulkhead door assembly comprising:

a bulkhead enclosure for mounting on a bulkhead, said bulkhead enclosure including fiberglass side walls, a sloping fiberglass top wall between said side walls and a tie bar connected between said side walls, said top wall having a door opening;

at least one fiberglass door movable between a closed position covering said door opening and an open position providing access to said bulkhead; and a top hinge and a bottom hinge for mounting said door to said bulkhead enclosure, each of said hinges including a fixed member attached to said bulkhead enclosure and a movable member attached to said door, the fixed member of said bottom hinge being rigidly affixed to said tie bar so as to transfer stress to said tie bar during opening and closing of said door.

10. A fiberglass bulkhead door assembly as defined in claim 9 wherein said tie bar comprises a metal strip positioned at the bottom of said door opening for attachment to said bulkhead.

11. A fiberglass bulkhead door assembly as defined in claim 10 wherein the fixed member of said bottom hinge has a right angle configuration including a first portion affixed to said tie bar and a second portion extending upwardly through said top wall for pivotal attachment to the movable member of said bottom hinge.

12. A fiberglass bulkhead door assembly as defined in claim 11 wherein said top wall is provided with an upwardly extending flange around the top and sides of said door opening and wherein said door is provided with a peripheral flange that surrounds said upwardly extending flange when said door is in its closed position.

13. A fiberglass bulkhead door assembly as defined in claim 12 wherein the movable members of said hinges are attached to the peripheral flange on said door.

14. A fiberglass bulkhead door assembly as defined in claim 9 wherein the fixed member of said top hinge has a right angle configuration including a first portion attached to an inside surface of said top wall and a second portion extending through said top wall for pivotal attachment to the movable member of said top hinge.

15. A fiberglass bulkhead door assembly as defined in claim 9 further including an air cylinder connected between said door and said bulkhead enclosure.

* * * * *